United States Patent [19]

Ward, deceased

[11] 3,967,065

[45] June 29, 1976

[54] PLEXIGLAS SPEAKERS

[75] Inventor: James M. Ward, deceased, late of Kansas City, Mo., Sandra Ward, surviving spouse

[73] Assignee: Sandra Ward, Kansas City, Mo.

[22] Filed: July 21, 1975

[21] Appl. No.: 597,773

[52] U.S. Cl. ..... 179/1 E; 181/148

[51] Int. Cl.[2] ..... H04R 1/02

[58] Field of Search ..... 179/1 E; 181/148, 199

[56] References Cited

UNITED STATES PATENTS 3,165,587 1/1965 Alderson ..... 179/1 E

*Primary Examiner*—George G. Stellar

[57] ABSTRACT

A novel speaker unit for incorporating into a high fidelity and sound system, the speaker unit consisting of a cabinet made of plexiglas, the plexiglas cabinet enclosing tweeter, midrange and woofer speakers, and the cabinet also carrying a crossover network with a volume knob and also carrying a female phono plugged as input connection.

5 Claims, 2 Drawing Figures

PLEXIGLAS SPEAKERS

This invention relates generally to high fidelity sound system components. More specifically the present invention relates to speaker units.

The principal object of the present invention is to provide a Plexiglas speaker unit in which the speakers are enclosed within a cabinet.

Another object of the present invention is to provide a Plexiglas speaker unit which also produces a fine quality of sound.

Other objects are to provide a Plexiglas speaker unit which is simple in design, rugged in construction, and efficient in operation.

These and other objects will be readily evident upon a study of the following specification and accompanying drawing wherein.

Figure 1:
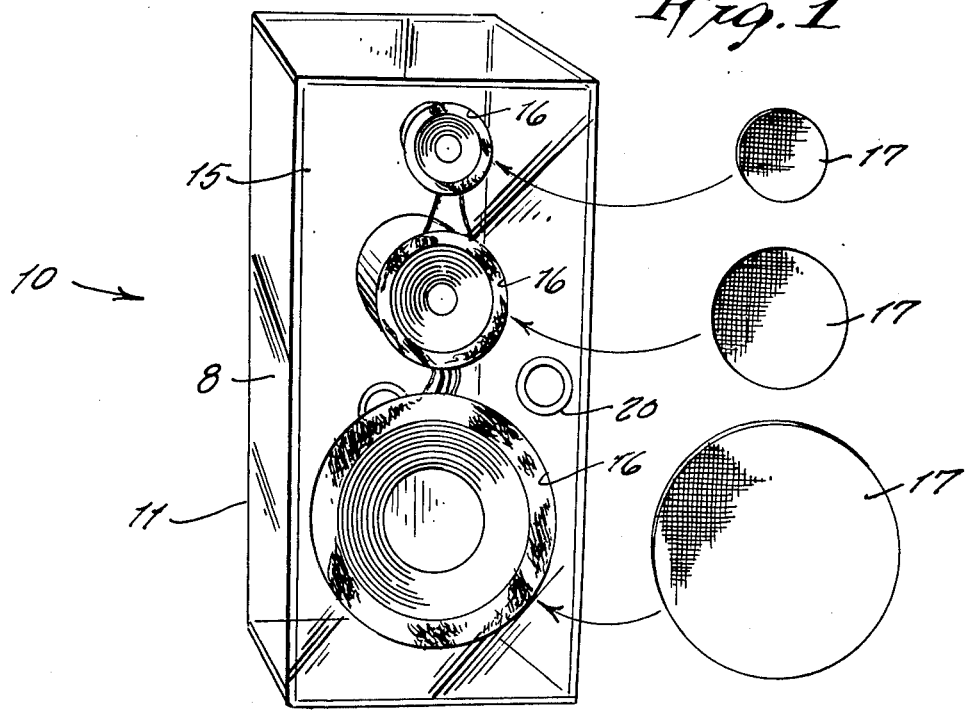
FIG. 1 is a perspective view of the present invention and shown with the grill materials removed so to permit observation of the tweeter, midrange and woofer speakers.

Referring now to the drawing in detail, the reference numeral 10 represents a Plexiglas speaker unit according to the present invention wherein the same includes a cabinet 11 that is made of Plexiglas material.

Within the interior of the cabinet 11 there is contained a tweeter speaker 12, a midrange speaker 13 and a woofer speaker 14 all of which are mounted against the inner side of a front wall 15, the wall being provided with openings 16 each being covered by material 17 through which the sound waves penetrate outwardly so that they may be heard.

As shown, the cabinet includes besides the front wall 15, also opposite side wall 8, rear wall 9, top wall 18 and bottom wall 19.

The front wall 15 also includes a port 20 extending therethrough.

A crossover network 21 is mounted upon the inner-side of rear wall 9, the crossover network being provided with a volume knob 22 protruding through the rear wall so that the tweeter may be manually adjusted. The rear wall 17 also supports a female phono plug 23 that serves as input connection for a remainder of the high fidelity sound system.

Figure 2:
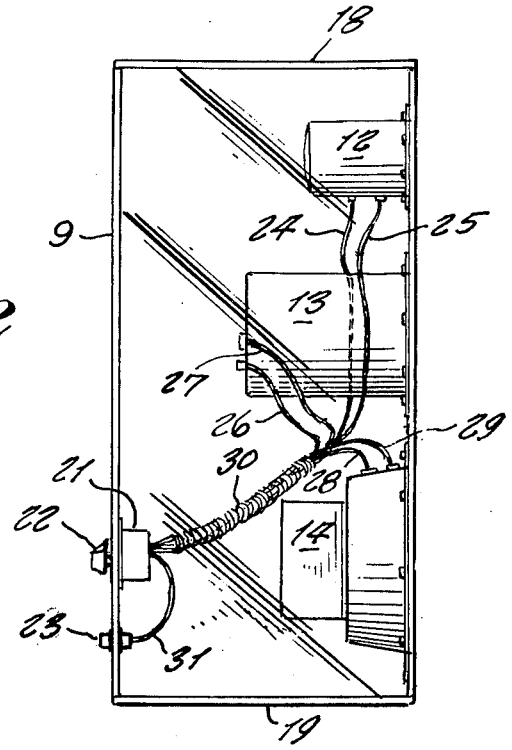
FIG. 2 is a side elevation view of the present invention.

As shown in the drawing, two wires 24 and 25 extend from the tweeter speaker and are wrapped around the midrange speaker, one wire being on each side extending to the crossover. FIG. 2 shows wires 26 and 27 extending to the back of the midrange speaker 13 and wires 28 and 29 extending to the woofer speaker. The wires 26, 27, 28 and 29 extend wrapped up together as shown at 30 and extending to the crossover network. The female phono jack 23 is connected by cable 31 to the crossover network.

Thus there is provided a novel plexiglas speaker unit in which produces a superb sound.

While various changes may be made in detailed construction, it is understood that such changes will be made within the spirit and scope of the present invention as defined in the appended claims.

What I claim is:

1. In a Plexiglas speaker unit the combination of a cabinet containing a plurality of speakers, means for connection of said speakers to exterior components of a high fidelity sound system.

2. The combination as set forth in claim 1, wherein said cabinet being made of Plexiglas material.

3. The combination as set forth in claim 2, wherein said Plexiglas cabinet includes a front wall, a rear wall, and another wall for completing an enclosure containing said speakers.

4. The combination as set forth in claim 3, wherein said speakers comprise a tweeter, a midrange and a woofer speaker, said speakers mounted upon a rear side of said front wall, opening through said front wall in front of each of said speakers, and said openings being enclosed by material.

5. The combination as set forth in claim 4, wherein a crossover network is mounted upon an innerside of said rear wall, said crossover network having a volume knob projecting outwardly of said cabinet, and said rear wall also supporting a female phono plug to form an input connection to said crossover network and said speakers.

* * * * *